United States Patent [19]

Ramseyer

[11] 4,315,388

[45] Feb. 16, 1982

[54] METHOD AND SYSTEM FOR MOUNTING A HEAVY SPHERICAL CONTAINER SHELL ON A FOUNDATION

[75] Inventor: Fritz Ramseyer, Elgg, Switzerland

[73] Assignee: Sulzer Brothers Limited, Winterthur, Switzerland

[21] Appl. No.: 93,998

[22] Filed: Nov. 14, 1979

[30] Foreign Application Priority Data

Nov. 24, 1978 [CH] Switzerland ..... 12053/78

[51] Int. Cl.[3] ..... E04H 14/00; E04B 1/36

[52] U.S. Cl. ..... 52/173 R; 52/742; 52/169.1; 220/1 B; 220/445

[58] Field of Search ..... 52/173, 167, 742, 2, 52/169.7, 169.1; 220/1 B, 448, 445, 18, 69; 110/256, 257

[56] References Cited

U.S. PATENT DOCUMENTS

| | | | |
|---|---|---|---|
| 1,499,967 | 7/1924 | Bowers | 52/2 |
| 2,287,197 | 6/1942 | Sandberg | 220/1 B |
| 2,887,759 | 5/1959 | Brownell | 52/742 |
| 3,568,392 | 3/1971 | Stark | 52/169.7 |
| 4,060,946 | 12/1977 | Lang et al. | 52/742 |
| 4,074,474 | 2/1978 | Cristy | 52/2 |

*Primary Examiner*—James L. Ridgill, Jr.
*Attorney, Agent, or Firm*—Kenyon & Kenyon

[57] ABSTRACT

Resilient support means are provided in the trough of the concrete foundation to receive the fabricated spherical shell. The resilient support means can be constructed so as to deform increasingly and permanently in response to an increasing load of the shell thereon or may be constructed so as to receive a pressurized medium. By determining variations in pressures at the various support means, changes can be affected so as to insure a uniform disposition of the shell on the concrete layer which is back filled into the gap between the shell and foundation.

20 Claims, 6 Drawing Figures

METHOD AND SYSTEM FOR MOUNTING A HEAVY SPHERICAL CONTAINER SHELL ON A FOUNDATION

This invention relates to a method and system for mounting a heavy spherical container shell on a foundation.

Heretofore, it has been known to mount heavy spherical container shells on a concrete foundation having a spherical trough generally shaped to the shape of the container shell. Generally, the foundation is a rough cast trough-shaped concrete foundation and the shell is assembled in pieces on supports located on the trough. After the shell has been assembled, water is introduced into the trough so as to float the shell off the supports. Thereafter, the supports are removed and the shell is lowered onto a number of support stations in the trough by removal of the water. Subsequently, the gap between the shell and the foundation is back filled with concrete. However, a difficulty arises in the practice of this method. That is, when the shell settles on the support stations, however accurately the stations may have been levelled, unavoidable deviations in the shape of the shell from a true geometric spherical shape occur which cause distortion and, therefore, additional stresses in the shell. These additional stresses can be reduced by a more accurate welding together of the shell, that is, by closer tolerances. However, it is very expensive to reduce such tolerances.

Accordingly, it is an object of the invention to provide a method and system for accurately mounting a spherical container shell on a concrete foundation.

It is another object of the invention to provide a system of mounting a spherical container shell on a foundation without imparting distortion into the shell.

It is another object of the invention to avoid imparting stresses into a container shell during mounting on a trough-shaped foundation.

It is another object of the invention to provide a low cost method of mounting heavy spherical shells on trough-shaped concrete foundations.

Briefly, the invention provides a method and system for mounting a heavy spherical container shell on a foundation such as a concrete foundation.

The method includes the steps of providing a foundation with a spherical trough, of positioning a multiplicity of props and resilient support means in the trough and of assembling a heavy spherical shell on the props in order to define a gap between the shell and foundation. Thereafter, water is introduced into the gap to float the shell off the props and, after removing the props, water is removed from the gap in order to lower the shell onto the resilient support means while distributing the load of the shell on the support means uniformly. Thereafter, the gap between the shell and trough is back filled with concrete.

The method has the advantage of making very accurate measurements of the resilient support means unnecessary. In addition, as the back filled concrete shrinks, the resilient support means do not remain rigid and form raised zones otherwise responsible for high stress peaks when the shell is loaded with internal components.

In accordance with the invention, the resilient support means are each adapted to receive a pressure medium and are vented and connected in common to each other before lowering of the shell thereon. This makes it possible to obviate completely additional relatively heavy stresses due to the shape of the shell being other than exactly spherical.

In addition, the support means can be sealed off with respect to each other as well as with respect to a pressure medium supply after complete lowering of the shell onto the support means. If back filling does not proceed too rapidly, this prevents the central part of the shell from lifting due to buoyancy as the concrete is being introduced.

If back filling proceeds too rapidly and the static height of the concrete becomes excessive, the buoyancy caused by the concrete may lift the shell off the support means. To this end, the pressure in each support means can be monitored and the back filling can be delayed in response to the pressure in a support means falling below a predetermined level. By observing the pressure in the discrete support means, the amount of buoyancy can be estimated and the rate of back filling suitably adjusted to obviate lift-off. In addition, the shell can be filled with water during the back filling step in order to maintain the pressure in the support means above a predetermined level. The loading of the shell can substantially compensate for poor buoyancy acting on the shell as a result of concrete water penetrating between the set concrete and the shell.

In accordance with the invention, the pressure medium can be removed from the support means after the concrete has developed bearing strength. The effect of relieving the support means of load while the back filled concrete is setting allows the bearing side of the support means to follow the shrinking concrete. Thus, the shell is supported by the concrete in a uniform manner. It is to be noted that the relieved zone near each support means is so small as to be insignificant relative to the stresses in the shell, e.g. a metal shell.

The various support means may also be disconnected from the pressure medium supply and can each be provided with a closure capable of opening in response to a positive pressure in the support means. This prevents the pressure from becoming excessive in the event of a heating of the pressure medium in the support means.

The support means can be arranged such that the central support means is elevated relative to the remainder of the support means in the trough in order to initially contact the shell upon lowering of the shell. This insures that the shell does not tilt during descent as a result of making an initial contact with a top support means.

In addition, the pressure in the central support means can be boosted higher than in the remainder of the support means after the shell contacts the central support means. This insures a minimal bearing pressure at the first-contacted central support means and thus obviates sliding thereon.

The pressure in a given support means may also be boosted during back filling in response to the pressure in the support means falling below a predetermined level. In this way, the bearing side of the support means follows the shell when the shell distorts because of bouyancy. Determining the quantity of pressure medium supplied gives an important clue as to the extent of possible distortion of the shell as a result of buoyancy.

The system or apparatus of the invention comprises a multiplicity of props disposed in the trough of the foundation for initially supporting an assembled spherical shell thereon in spaced relation to the trough in order to define a gap between the shell and trough. In addition, the system includes a multiplicity of resilient support means in the trough, means for introducing and removing water into and from the gap to float the shell off the props in order to permit removal of the props and to thereafter lower the shell onto the resilient support means and means for introducing concrete into the gap in order to support the shell on the trough upon setting and developing bearing strength. The resilient support means may be of any suitable construction. For example in the embodiment, each support means is in the form of a hollow sheet metal member disposed to deform increasingly and permanently in response to an increasing load of the shell thereon. In this regard, hollow sheet metal members, for example horizontally disposed pieces of tube of appropriate diameter and wall thickness are inexpensive. Since such members distort permanently and not elastically, there is no risk of the shell being distorted during back filling by a reaction force combined with buoyancy due to the flowable concrete.

In another embodiment, the resilient support means may include a tubular element and a balloon disposed within and projecting from the tubular element in order to support the shell thereon. This also provides a relatively inexpensive support means. In still another embodiment, each resilient support means includes a cylinder which is mounted on the trough and a reciprocal piston slidably mounted in the cylinder. In this embodiment, the piston is pressurized. Accordingly, the bearing force of each support means can be determined accurately because the piston has a defined area.

In order to prevent each individual piston from being ejected from the respective cylinder when the shell has not been lowered, a suitable abutment is used to limit the outward movement of the piston from the cylinder.

The resilient support means may each include a chamber for receiving a pressure medium. In this regard, the chamber is responsive to the shell being lowered onto the support means so as to increase the pressure on the pressure medium therein. Such a system simplifies the performance of the various components of the system. In order to boost the pressure in the central support means so as to insure that the shell can be located thereon by friction, suitable means are provided. This means may include a ring main, connecting lines which extend in parallel from the ring main to the respective chambers, a plurality of valves each disposed in a connecting line to control a flow of pressure medium therein and a pressure senser in each connecting line between a support means and a valve. In addition, a pressure medium supply means is provided with a closable feed line between the supply means and the ring main to deliver pressurized medium to the ring main and a closeable discharge line between the supply means and ring main to return pressure medium from the ring main to the supply means.

In addition, a discharge line can be connected to the connecting line extending from the central support means between this support means and the valve in the connecting line while a sealingly closeable restrictor is provided in the discharge line in order to boost the pressure in the central support means to insure that the shell is located thereon by friction.

In order to detect any local lifting of the shell due to buoyancy, a check valve is connected to at least one of the connecting lines while a conduit connects the check valve to the discharge line upstream of the restrictor. In addition, means for measuring the quantity of pressure medium transferred to the connecting line is connected to the check valve to measure the quantity of pressure medium transferred via the check valve and supply means. The effect of this structure is that the bearing surface of the support means near the deformation follows the shell and the extent of movement can be determined.

These and other objects and advantages of the invention will become more apparent from the following detailed description and appended claims taken in conjunction with the accompanying drawings in which:

Figure 1:
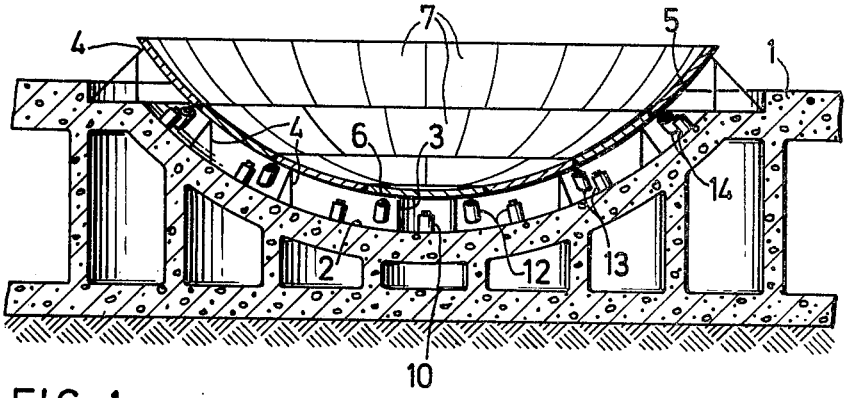
FIG. 1 illustrates a vertical sectional view through a spherical shell erected on props above a concrete foundation in accordance with the invention.

Referring to FIG. 1, a heavily ribbed concrete foundation 1 which forms a part-spherical trough 2 is sized to receive a bottom spherical shell 5 of a spherical reactor safety container. The shell 5 is formed of a plurality of sections including bottom spherical cap 6 and a number of sheet metal spherical rectangles 7 which are welded together. The shell 5 is assembled and initially supported on the trough 2 via a multiplicity of props 4 disposed in the trough 2. These props include a central sheet metal cylinder 3 which is combined from cylindrical shells. In addition, a multiplicity of resilient support means are also provided in the trough 2 in spaced relation to the shell 5. As indicated the resilient support means includes a central support means 10, six resilient support means 12 distributed uniformly around an innermost circle, twelve support means 13 similarly distributed in a central circle and eighteen support means 14 similarly distributed about an outer circle.

The resilient support means are constructed so as to deform increasingly and permanently in response to an increasing load of the shell 5 thereon as explained below.

Figure 2:
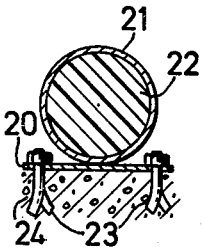
FIG. 2 illustrates a vertical section through a support means in accordance with the invention.

Referring to FIG. 2, the resilient support means 10, 12, 13, 14 may be constructed of a hollow sheet metal tubular member 21 which is disposed on and welded to a base plate 20. The member 21 is filled with a synthetic foam 22 while the base plate 20 is secured to the concrete foundation 24 via ties or the like 23. As indicated, the ties 23 extend through suitable bores in the base plate 20 so as to bolt the base plate to the foundation 24.

Figure 3:
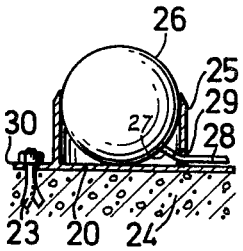
FIG. 3 illustrates a vertical sectional view through a further embodiment of a resilient support means in accordance with the invention.

Alternatively, as shown in FIG. 3, each resilient support means may be constructed of a tubular element 25 which is vertically disposed and welded on a base plate 20 and a balloon 26 of spherical shape which is disposed within and which projects from the tubular element 25. As shown, the base plate 20 is bolted to the foundation 24 via ties 23 and nuts 30. In addition, the balloon 26 is provided with a spigot 27 which connects to a connecting line 28 extending through an aperture 29 in the tubular element 25 for purposes as explained below.

Figure 4:
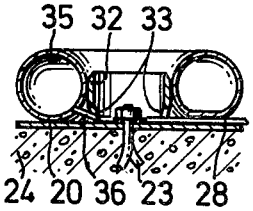
FIG. 4 illustrates a vertical sectional view through a still further embodiment of a resilient support means in accordance with the invention.

Still further, as shown in FIG. 4, each resilient support means may include a cylinder 32 having diametrically opposite recesses 33 and which is welded to a base plate 20. As above, the base plate 20 is bolted to the foundation 24 via ties. In addition, the resilient support means has an inflatable tire 35 placed around the member 32. The tire 35 is provided with a spigot 36 which is connected without a valve to a connecting line 28 which extends diametrically through the recesses 33 in the tubular member 32.

Figure 5:
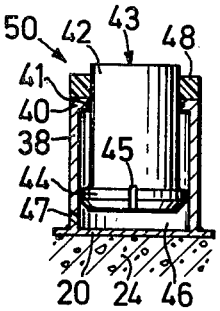
FIG. 5 illustrates a vertical sectional view through a further resilient support means in accordance with the invention.

Referring to FIG. 5, each resilient support means may also be constructed in the manner of a pressure cylinder 50 with an associated piston 43. As shown, the cylinder 50 includes a steel cylinder 38 which has a drawn-in part 40 at the upper free end and which is welded in seal tight fashion to a base plate 20. As above, the base plate 20 is secured to the foundation 24 in suitable manner. In addition, an O-ring 41 is disposed in an annular groove in the drawn-in part 40 while a cylindrical part 42 of the piston 43 slides on the ring 41. The bottom of the piston 43 includes a shoulder 44 which guides the piston 43 in reciprocal manner within the cylinder 38 and also forms an abutment for limiting outward movement of the piston 43 from the cylinder 38. This shoulder 44 is interrupted by a groove 45 so as to communicate an annular chamber above the shoulder with a chamber 46 below the piston 43. As shown, the chamber 46 is connected via a bore 47 in the cylinder 38 to a connecting line (not shown). The part of the piston 43 which projects from the cylinder 38 carries an annular collar 48 which is made of resilient foam and which prevents the formation of a concrete ring around the piston 43.

The various support means as shown in FIGS. 3, 4 and 5 each have a chamber for receiving a pressure medium for purposes as explained below.

Referring to FIG. 1, in order to mount the heavy spherical shell 5 on the foundation 1, the various props 3, 4 and resilient support means such as the hollow sheet metal members 21 of FIG. 2 are disposed within the trough 2. The shell 5 is then assembled on the props 3, 4 so as to define a gap between the shell 5 and the foundation 1. Thereafter water is introduced into the gap and the trough 2 is filled with water so that the shell 5 is floated off the props 3, 4. Thereafter, the props 3, 4 are dismantled. Thence, the water is slowly discharged through a discharge aperture (not shown) whereby care is taken by manual action or by supporting of the shell to insure that the shell 5 does not shift laterally. During removal of the water from the gap, the shell is lowered onto the resilient support means by distributing the load of the shell 5 on these support means uniformly. When the shell 5 abuts the support means, these support means distort plastically in dependence on the shape of the shell 5. Since the stress-strain characteristic of the sheet metal members 21 of FIG. 2 is theoretically similar to that of a spring, the bearing forces of the various support means are not exactly equal to one another. Instead, they are more similar by several orders of magnitude than in the case of a conventional rigid support station. While the shell experiences some deformation because of the different bearing forces, the deformation experienced is considerably less than if the shell 5 had settled on non-resilient support means.

Thereafter, the gap is back filled between the shell 5 and the trough 2 with concrete. To this end, the concrete is injected into the gap starting from the center via flexible or other lines which have been previously positioned. The concrete is injected in ring zones with care being taken to insure that the back filling operation does not proceed too rapidly so as to avoid having the buoyancy of the concrete disengage the shell 5 from the support means. It is to be noted that additional buoyancy may be caused near a concrete layer which has set if, as the concrete settles, evolved water spreads into an initially narrow gap between the concrete layer and the spherical shell 5. Further, since the injected concrete layer shrinks radially during setting, the support means may experience further compression. Also, the support means, being resilient, will experience further compression if there is a subsequent loading of the inside of the shell 5, for example by structures which are erected within the shell. However, no appreciable additional stresses would arise in the shell 5.

Where the resilient support means of FIGS. 3 and 4 are disposed in the trough 2, each is connected by way of a valve connecting line 28 to a suitable pressure medium supply means. In this case, the pressure medium used is preferably water at a pressure of, for example 20 bars. When these inflatable resilient support means are used, they are all placed in communication with one another by way of the connecting lines 28 and opened valves during lowering of the shell 5. Consequently, the pressure in all of the pressurized support means is the same. Hence, disregarding the effects of inequalities in the size of the bearing surface, the bearing forces in all the support means are the same. When back filling is carried out, mainly when concrete is being injected into the gap between the shell 5 and the foundation 1, the valves are closed. This insures that the buoyancy of the concrete and the complete force of the support means do not interact in the region where the concrete has been introduced. If there is an interaction, the shell 5 would be bound to lift or distort. Conveniently, the pressurized support means near a layer of concrete which has been set have the inner pressures reduced.

Figure 6:
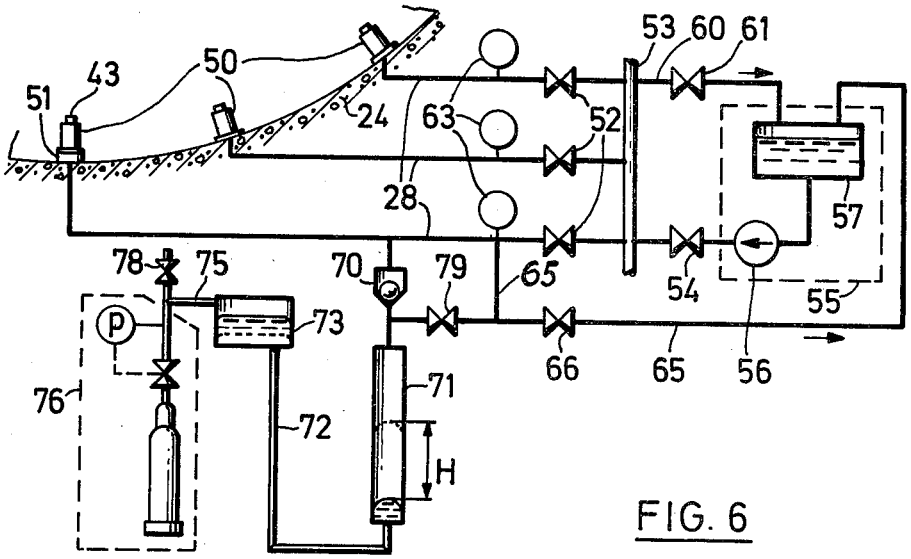
FIG. 6 illustrates a schematic circuit of a means for supplying pressurized medium to a plurality of resilient support means in accordance with the invention.

When using the resilient support means of FIG. 5, a system as shown in FIG. 6 can be used to interconnect the various support means 50. To this end, as shown in FIG. 6, a multiplicity of cylinders 50 are mounted on the concrete foundation 24 with the innermost or central cylinder 50 being elevated relative to the remainder of the cylinders 50 via a shim or the like 51 so as to initially contact the shell 5 during lowering of the shell 5. In addition, a ring main 53 is connected via a plurality of connecting lines 28 which extend in parallel to the respective cylinders 50. Each connecting line 28 has a valve 52 therein to control a flow of pressure medium therein as well as a pressure sensor 63 which is disposed between a piston 50 and the valve 52. In addition, the ring main 53 is connected to a pressure medium supply means 55 in the form of a pump 56 and a water tank 57. A closeable feed line having a valve 54 connects the supply means 55 to the ring main 53 in order to deliver pressurized medium to the ring main 53. In like manner, a closeable discharge line 60 having a valve 61 connects the ring main 53 to the tank 57 so as to return pressure medium from the ring main 53 to the tank 57.

A discharge line 65 is also connected to a connecting line 28 connected to the central piston 50 as well as to the tank 57 in order to return water to the tank 57. This discharge line 65 is disposed between the central piston 50 and the valve 52 in the connecting line 28 and has a sealingly closeable restrictor in the form of a throttle valve 66 therein. A check valve 70 is also connected to the connecting line 28 to the central piston 50 so as to permit delivery of pressurized medium to the connecting line 28 from a conduit having a valve 79 therein which connects the check valve 70 to the discharge line 65 upstream of the valve 66. In addition, a means is connected to the check valve 70 for measuring the quantity of pressure medium transferred to the connecting line 28. To this end, this means includes a pipe which extends from the entry side of the check valve 70 to a transparent vertical tube 71, a raised tank 73 which is connected at the bottom via a line 72 to the bottom of the vertical tube 71 and a supply 76 of a controlled gas pressure which is connected via a line 75 to the top of the tank 73. In addition, a relief valve 78 is disposed on the line 75.

A supply of liquid which is not miscible with water and which is heavier than water, for example quicksilver, is disposed in the tank 73, line 72 and the bottom region of the vertical tube 71.

Before mounting the shell 5 on the pistons 50 of FIGS. 5 and 6, the shoulder 44 of the pistons 43 abut the draw-in port 40 of the cylinder 38 due to a slight positive pressure of the internal pressure medium. The valves 54, 61 and the valve 52 associated with the central cylinder 50 are in a closed state while the other valves 52 are in an open state. As the shell 5 descends, the bottom part 6 abuts the piston 43 of the central cylinder. This causes an increase in the pressure, as indicated by the corresponding pressure sensor 63, and the pressure increases as the shell 5 continues to descend. The valve 66 can then be open slightly to prevent the pressure from exceeding a value corresponding to a support means loading of approximately 10 tons. During continued descent, the shell 5 begins to bear on the other support means. This is indicated by an increase in the pressure in the connecting lines 28 as sensed by the remaining sensors 63. Water is then discharged until the pressure indicated by the sensors 63 indicate a value corresponding to a loading of approximately 5 tons. The valve 61 is then opened a slight amount while the level in the tank 57 is observed and approximately one third of the total amount of water in the pressure cylinders 50 is slowly discharged into the tank 57. Also, the valve 52 opens and the valve 66 finally closes. Meanwhile, the water present in the gap between the foundation 1 and the shell 5 has been completely discharged. If not at the correct height, the shell 5 can be raised or lowered by pumping water in through the valve 54 or by discharging water through the valve 61.

Thereafter, all the valves 52 close and concrete is pumped into the gap between the foundation 1 and the shell 5. The injection of the concrete starts in the center and proceeds in circular zones. During this time, the pressure indicated by the sensors 63 is observed. If the pressure indicated by any sensors 63 drops rapidly, this indicates that the shell 5 is experiencing excessive local buoyancy. Thus, the injection of the concrete in this area should be slowed down or stopped. It may also be advantageous to fill the shell 5 increasingly with water as the back filling step proceeds. The water which is thus introduced into the shell balances the water distributing through any gap arising between the injected concrete and the shell.

If despite all precautions, the buoyancy of the concrete has become excessive somewhere, the corresponding pressure sensor 63 indicates zero pressure. In this case which occurs first of all near the bottom part of the shell 5, if the corresponding connecting line 28 includes the means 70–79, water is automatically injected via the check valve 70 from the vertical tube 71 into the corresponding line 28. In this way, the piston 43 in the corresponding cylinder 50 follows the moving shell 5. The resulting shift of the surface of the quicksilver in the vertical tube 71 by the vertical distance H gives an indication of how much the piston has shifted. The valve 79 can then be opened to see how the shell behaves subsequently, i.e. upon discharge of the water from the gap below the shell 5 and when the shell 5 is loaded by suitable equipment. If required, the back pressure operative on the quicksilver of mercury column can be corrected by opening of the valve 78.

Upon completion of adjustment, it may be convenient to sever the connecting lines 28 near where they issue from the back filled concrete, to seal the end with a plastic cap and to disconnect the various means 52–79 for use elsewhere.

The invention thus provides a relatively simple method and system for mounting a heavy spherical container shell on a concrete foundation without introducing stresses and strains in the shell due to the shell not being made exactly spherical.

What is claimed is:

1. An apparatus for mounting a heavy spherical container shell on a foundation defining a spherical trough, said apparatus comprising a multiplicity of props disposed in said trough means for introducing and removing water into and from said gap for floating said shell off said props to permit removal of said props from between said shell and said trough and to thereafter lower said shell onto said resilient support means; and means for introducing concrete into said gap to support said shell on said trough upon setting and developing bearing strength.

2. An apparatus as set forth in claim 1 wherein each said resilient support means is a hollow sheet metal member disposed to deform increasingly and permanently in response to an increasing load of said shell thereon.

3. An apparatus as set forth in claim 1 wherein each said resilient support means includes a tubular element and a balloon disposed within and projecting from said tubular element to support said shell thereon.

4. An apparatus as set forth in claim 1 wherein each said resilient support means includes a tubular member and an inflatable tire placed around said member.

5. An apparatus as set forth in claim 1 wherein each said resilient support means includes a cylinder mounted on said trough and a reciprocal piston slidably mounted in said cylinder.

6. An apparatus as set forth in claim 5 wherein each support means includes an abutment limiting outward movement of said piston from said cylinder.

7. An apparatus as set forth in claim 1 wherein each support means has a chamber receiving a pressure medium therein, said chamber being responsive to said shell being lowered onto said support means to increase the pressure on the pressure medium therein.

8. An apparatus as set forth in claim 7 which further comprises a ring main; a plurality of connecting lines extending in parallel from said ring main, each said connecting line being connected to a chamber of a respective support means; a plurality of valves, each said valve being disposed in a respective connecting line to control a flow of pressure medium therein; a plurality of pressure sensers, each said senser being disposed in a respective connecting line between a support means and a valve; a pressure medium supply means; a closeable feedline between said supply means and said ring main to deliver pressurized medium to said ring main; and a closeable discharge line between said supply means and said ring main to return pressure medium from said ring main to said supply means.

9. An apparatus as set forth in claim 8 which further comprises a discharge line connected to said connecting line extending to a central support means, said discharge line being disposed between said central support means and said valve in said connecting line, and a sealingly closeable restrictor in said discharge line.

10. An apparatus as set forth in claim 9 which further comprises a check valve in at least one of said connecting lines, a conduit connecting said check valve to said discharge line upstream of said restrictor to deliver pressurized medium through said check valve to said one connecting line, and means connected to said check valve for measuring the quantity of pressure medium transferred to said one connecting line.

11. A method of mounting a heavy spherical container shell comprising the steps of providing a foundation defining a spherical trough;

positioning a multiplicity of props and resilient support means in said trough;

assembling a plurality of sections to provide a heavy spherical shell on said props to define a gap between said shell and foundation;

introducing water into said gap floating said shell off said props;

thereafter removing said props;

thence removing the water from said gap and lowering said shell onto said resilient support means while distributing the load of said shell on said support means uniformly; and thereafter backfilling the gap between said shell and said trough with concrete.

12. A method as set forth in claim 1 wherein a central support means is elevated relative to the remainder of said support means in said trough to initially contact said shell upon lowering of said shell.

13. A method as set forth in claim 12 wherein said resilient support means each receive a pressure medium, each resilient support means being vented and connected in common to each other before lowering of said shell thereon and which further comprises the step of boosting the pressure in said central support means higher than in the remainder of said support means after said shell contacts said central support means.

14. A method as set forth in claim 11 wherein said resilient support means each receive a pressure medium, each resilient support means being vented and connected in common to each other before lowering of said shell thereon.

15. A method as set forth in claim 2 which further comprises the step of filling said shell with water during said step of backfilling to maintain the pressure in said support means above a predetermined level.

16. A method as set forth in claim 14 further comprising the steps of sealing off said support means with respect to each other after complete lowering of said shell onto said support means.

17. A method as set forth in claim 3 which further comprises the steps of monitoring the pressure in each resilient support means and of delaying said backfilling step in response to the pressure in a support means falling below a predetermined level.

18. A method as set forth in claim 4 which further comprises the step of boosting the pressure in a given support means during backfilling in response to the pressure on said given support means falling below a predetermined level.

19. A method as set forth in claim 2 which further comprises the step of removing pressure medium from said support means after the concrete has developed bearing strength.

20. A method as set forth in claim 7 which further comprises the steps of disconnecting said support means from a pressure medium supply and providing each support means with a closure capable of opening in response to a positive pressure in said respective support means.

* * * * *